US005765484A

United States Patent [19]

Lam

[11] Patent Number: 5,765,484

[45] Date of Patent: Jun. 16, 1998

[54] STAMPING DEVICE HAVING SKIRT AND SPRING COMBINATION

[75] Inventor: Jackie Yuk Pang Lam, Hong Kong, Hong Kong

[73] Assignee: Mark Universal Ltd., Hong Kong, Hong Kong

[21] Appl. No.: 692,514

[22] Filed: Aug. 6, 1996

[30] Foreign Application Priority Data

Aug. 7, 1995 [GB] United Kingdom ..... 9516172

[51] Int. Cl.[6] ..... B41K 1/38; B41K 1/42; B41K 1/00

[52] U.S. Cl. ..... 101/327; 101/333; 101/103

[58] Field of Search ..... 101/327, 334, 101/333, 103, 104, 109

[56] References Cited

U.S. PATENT DOCUMENTS

| | | | |
|---|---|---|---|
| 2,966,116 | 12/1960 | Harris et al. | 101/327 |
| 3,158,094 | 11/1964 | Harris et al. | 101/327 |
| 3,442,209 | 5/1969 | Funahashi | 101/327 |
| 3,570,396 | 3/1971 | Schwartzmann | 101/327 |
| 3,631,799 | 1/1972 | Funahashi | 101/327 |
| 3,952,653 | 4/1976 | McFarland | 101/327 |
| 4,289,070 | 9/1981 | MacGregor | 101/327 |
| 4,432,281 | 2/1984 | Wall et al. | 101/334 |

FOREIGN PATENT DOCUMENTS

| | | | |
|---|---|---|---|
| 1004794 | 8/1963 | United Kingdom | 101/109 |
| 1269460 | 4/1972 | United Kingdom . | |

*Primary Examiner*—Edgar S. Burr
*Assistant Examiner*—Leslie Grohusky
*Attorney, Agent, or Firm*—Miller, Sisson, Chapman & Nash, P.C.

[57] ABSTRACT

A stamping device (10) which comprises a body (11) having an open bottom end (12), a stamping member (21) provided at the body bottom end (12), a skirt (14) supported at the body bottom end (12) around the stamping member (21) for movement between a lower position to protect the stamping member (21) and an upper position to expose the stamping member (21) for stamping operation, and a spring (15). The spring (15) forms a one-piece structure with the skirt (14) and is adapted to resiliently bias the skirt (14) into the lower position. The spring (15) comprises opposite sides (16) joining the skirt (14) and an upper side (17) extending across the opposite sides (16).

10 Claims, 2 Drawing Sheets

STAMPING DEVICE HAVING SKIRT AND SPRING COMBINATION

The present invention relates to a stamping device.

BACKGROUND OF THE INVENTION

Stamping device having a pre-inked stamp and a spring-loaded skirt normally protecting or enclosing the pre-inked stamp are generally known. In one form, the spring or springs acting upon the skirt are separate parts which thus requires special attention in the assembling process. In another form, although the springs are integrally formed with the skirt, two springs are used on one side of the skirt, which operate independently of each other and are found to provide an unsatisfactory, unbalanced biasing action.

The invention seeks to provide an improved stamping device which does not have the aforesaid disadvantages.

SUMMARY OF THE INVENTION

According to the invention, there is provided a stamping device which comprises a body having an open bottom end, a stamping member provided at the body bottom end, a skirt supported at the body bottom end around the stamping member for movement between a lower position to protect the stamping member and an upper position to expose the stamping member for stamping operation, and a spring forming a one-piece structure with the skirt and adapted to resiliently bias the skirt into the lower position, which spring comprises opposite sides joining the skirt and an upper side extending across said opposite sides.

Preferably, the spring is an integral part of the skirt.

More preferably, the body and the spring are moulded from plastics material.

In a preferred embodiment, the upper side of the spring has opposite ends engaging a part of the body.

More preferably, the upper side of the spring is slightly concave upwards.

Even more preferably, each opposite side of the spring is substantially C-shaped.

It is preferred that the part of the body with which the spring engages is in the form of a shoulder.

In another preferred embodiment, each opposite side of the spring is substantially S-shaped and has an upper end engaging a part of the body.

More preferably, the upper end of each opposite side of the spring engages the part of the body at a small angle.

It is preferred that the part of the body with which the spring engages is in the form of a shoulder.

Advantageously, the skirt incorporates a pair of said springs on opposite sides.

BRIEF DESCRIPTION OF DRAWINGS

The invention will now be more particularly described, by way of example only, with reference to the accompanying drawings, in which.

DETAILED DESCRIPTION OF PREFERRED EMBODIMENT(S)

Figure 1:
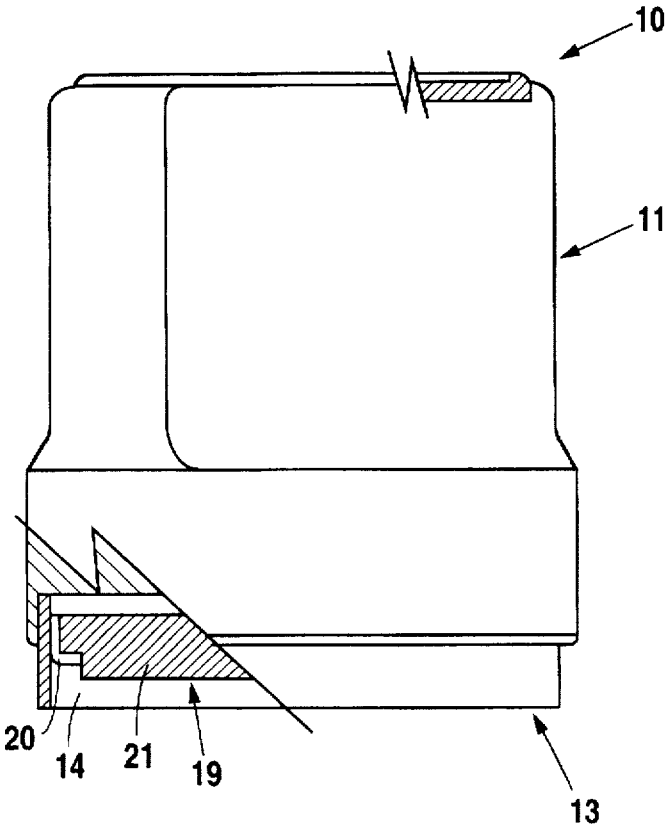
FIG. 1 is a front view, partially sectioned, or an embodiment of a stamping device in accordance with the invention.
Figure 2:
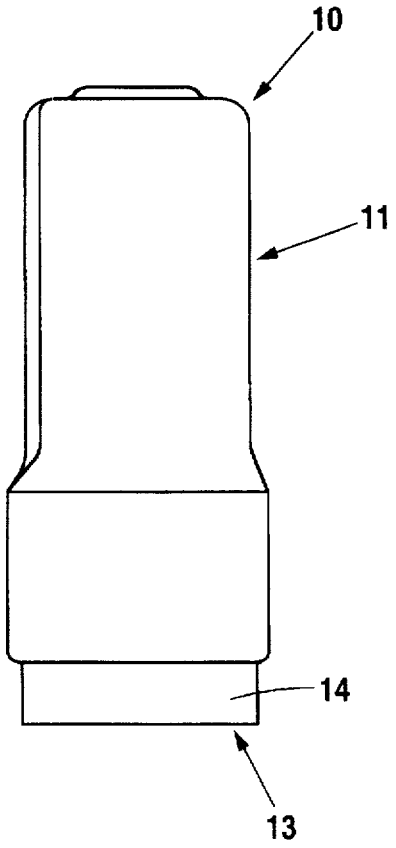
FIG. 2 is a side view of the stamping device of FIG. 1.
Figure 3:
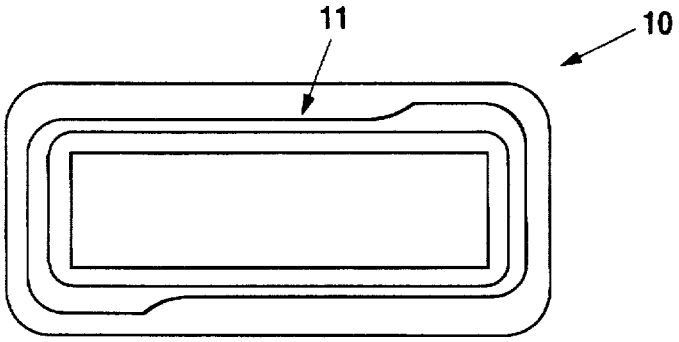
FIG. 3 is a top plan view of the stamping device of FIG. 1.
Figure 4:
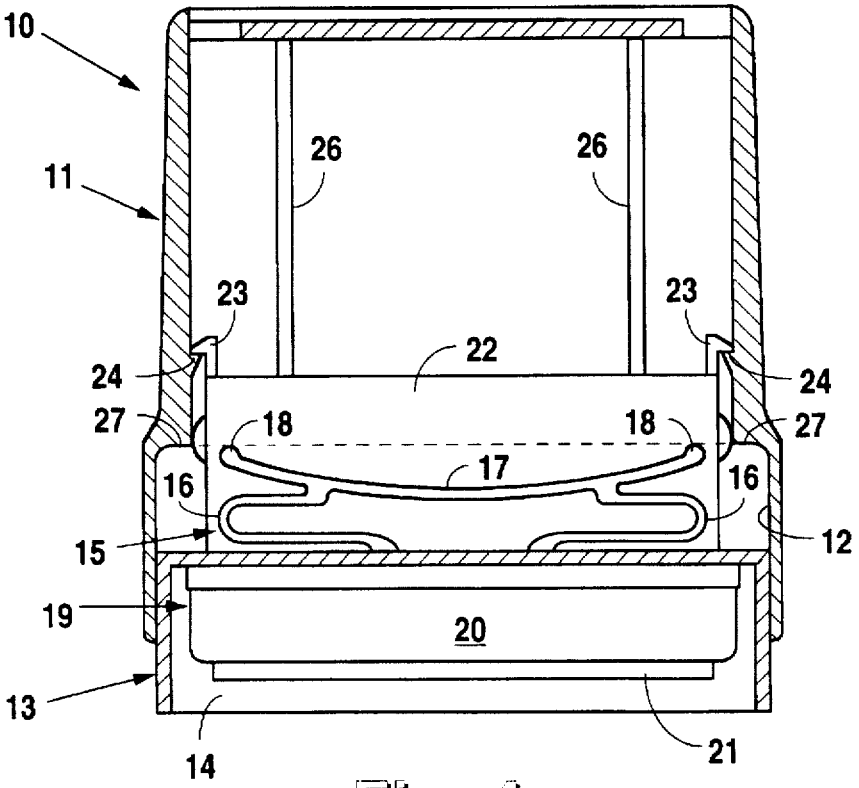
FIG. 4 is a cross-sectional front view of the stamping device of FIG. 1.
Figure 5:
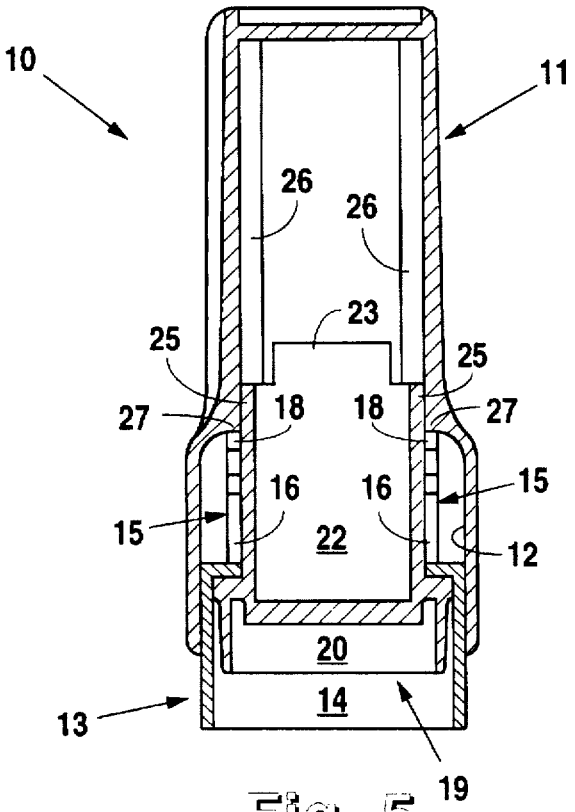
FIG. 5 is a cross-sectional side view of the stamping device of FIG. 1.

Referring to the drawings, there is shown a stamping device 10 embodying the invention, which stamping device 10 comprises an upright hollow main body 11 having a shape generally flat rectangular. Bottom end 12 of the main body 11 is open, extending through which there is provided a movable hollow base 13. The base 13 has a bottom skirt 14 which is generally rectangular sleeve-like and fits loosely within the body end 12 for vertical sliding movement relative thereto and a pair of springs 15 which extend upwards from atop opposite sides of the skirt 14. The skirt 14 and the springs 15 are integrally moulded from plastics material to form a one-piece structure.

Each spring 15 has a pair of opposite substantially C-shaped sides or legs 16 joining a corresponding upper side of the skirt 14 and a horizontal upper side or bar 17 extending across and supported by the legs 16. The bar 17 is slightly concave upwards to have its opposite ends 18 uppermost. Looking at a different perspective, each leg 16 and the respective end 18 of bar 17 forms a substantially S-shaped member, with the intermediate part of the bar 17 extending between the two S-shaped members.

The stamping device 10 further includes a stamper 19 for carrying out the actual stamping operation. The stamper 19 has a hollow rectangular body 22 which is provided at opposite ends with a pair of upstanding hooks 23. The stamper 19 includes a slightly expanded integral base mount 20 which is generally rectangular and lies horizontally for holding therein a pre-inked stamp 21 facing downwards.

To assemble the stamping device 10, the base 13 is firstly placed partially inside the bottom end 12 of the main body 11. The stamper 19 is then inserted through the base 13 into the main body 11 until the hooks 23 of the stamper body 22 snap to engage behind corresponding protrusions 24 provided integrally on the opposite end walls of the main body 11, whereby any subsequent withdrawal of the stamper 19 is prohibited. In this position, opposite side walls 25 of the stamper body 22 come into abutment with four vertical ribs 26 provided integrally on the opposite side walls of the main body 11, whereby any further insertion of the stamper 19 is stopped. The stamper 19 is thus fixed in position inside the main body 11. The pre-inked stamp 21 protrudes slightly out of the bottom end 12 of the main body 11 to perform stamping action.

Just before the stamper 19 reaches its fixed position inside the main body 11, the uppermost ends 18 of each spring 15 of the base 13 engage, at a small angle, with a downward-facing peripheral shoulder 27 formed around the inner side of the main body 11, whereby the two springs 15 are subsequently loaded to push the bottom skirt 14 resiliently downwards. In the lowermost position, the base 13 rests on and over the base mount 20 of the stamper 19, with its skirt 14 extending downwards beyond the pre-inked stamp 21 to protect the stamp 21 when the stamp 21 is not in use. The skirt 14 is useful for the overall stamping device 10 to stand and/or position on a surface, for example a piece of paper, without having the pre-inked stamp 21 touching that piece of paper.

Pressing of the main body 11 of the stamping device 10 downwards will cause the stamper 19 and hence the pre inked stamp 21 to move downwards to stamp on the piece of paper, with the base 13 including the skirt 14 retrieving into the main body 11, against the action of the springs 15, to permit the stamping operation. Release of the main body 11 allows the skirt 14 to re-extend downwards from the main body 11 to cover or enclose the pre-inked stamp 21 again.

As the stamper 19 is fixed relative to the main body 11, it is envisaged that the springs 15 may be arranged to act upon the stamper 19, instead of directly upon the main body 11, in order to resiliently bias the skirt 14 downwards to protect the pre-inked stamp 21. In this regard, the outer surface of the body 22 of the stamper 19 may have suitable protrusions for the upper ends 18 of the springs 15 to engage. With this arrangement, the stamper 19 is firstly inserted through the base 13 before the two inter-engaged parts 13 and 19 are finally snapped into the main body 11.

In a different embodiment, the base 13 may be provided on the outside of the bottom end 12 of the main body 11 to have its skirt 14 surrounding the bottom end 12. The associated springs 15 may be provided lying on the inner side of the skirt 14 to act upon respective suitable abutments on the outer surface of the bottom end 12 to urge the skirt 14 downwards.

According to the invention, the skirt 14 and the springs 15 are integrally formed or otherwise pre-connected together to form a one-piece structure to facilitate the assembly of the stamping device 10. Also, as the opposite sides or legs 16 of each spring 15 are connected together by the upper side or bar 17, the biasing action provided by the legs 16 and hence the overall spring 15 is balanced.

The invention has been given by way of example only, and various other modifications of and/or alterations to the described embodiment may be made by persons skilled in the art without departing from the scope of the invention as specified in the appended claims.

What is claimed is:

1. A stamping device comprising a body having an open bottom end;

a stamping member provided at said body bottom end;

a skirt supported at said body bottom end around said stamping member for movement between a lower position to protect said stamping member and an upper position to expose said stamping member for stamping operation, said skirt having an upper end surrounded by said body bottom end and a lower end exposed outside and below said body bottom end; and an internal spring forming a one-piece structure with said upper end of said skirt and adapted to resiliently bias said skirt into said lower position said spring further comprising a pair of opposite side members joining said upper end of said skirt and an upper member inter-connecting across said side members.

2. A stamping device as claimed in claim 1, wherein said body and said spring are molded from plastics material.

3. A stamping device as claimed in claim 1, wherein said upper member of said spring has opposite ends engaging an internal part of said body.

4. A stamping device as claimed in claim 3, wherein said upper member of said spring is slightly concave upwards.

5. A stamping device as claimed in claim 4, wherein each opposite side member of said spring is substantially C-shaped.

6. A stamping device as claimed in claim 3, wherein said internal part of said body with which said spring engages is a shoulder.

7. A stamping device as claimed in claim 1, wherein each opposite side member of said spring is substantially S-shaped and has an upper end engaging an internal part of said body.

8. A stamping device as claimed in claim 7, wherein said upper end of each opposite side member of said spring engages said internal part of said body at a small angle.

9. A stamping device as claimed in claim 7, wherein said internal part of said body with which said spring engages is in a shoulder.

10. A stamping device as claimed in claim 1, wherein said skirt incorporates a pair of said internal springs separately on opposite sides of said skirt.

* * * * *